United States Patent [19]

Jemal

[11] 3,988,012

[45] Oct. 26, 1976

[54] ROTARY HEARTH

[76] Inventor: Emile Joseph Jemal, 67 Davenport Road, Yonkers, N.Y. 10710

[22] Filed: Mar. 5, 1974

[21] Appl. No.: 448,195

Related U.S. Application Data

[63] Continuation of Ser. No. 226,819, Feb. 16, 1972, abandoned.

[52] U.S. Cl. ..... 266/179

[51] Int. Cl.[2] ..... F27B 21/00

[58] Field of Search ..... 266/20, 21, 176–179

[56] References Cited

UNITED STATES PATENTS

| | | | |
|---|---|---|---|
| 996,548 | 6/1911 | Wilfley | 266/20 |
| 1,075,011 | 10/1913 | Christensen | 266/21 |
| 1,989,662 | 2/1935 | Bernhard et al. | 266/20 |
| 2,488,115 | 11/1949 | Benos | 266/20 |
| 3,370,937 | 2/1968 | Tsujihata et al. | 266/21 |
| 3,452,972 | 7/1969 | Beggs | 266/20 |
| 3,667,746 | 6/1972 | Makarov et al. | 266/21 |

FOREIGN PATENTS OR APPLICATIONS

| | | | |
|---|---|---|---|
| 839,473 | 4/1939 | France | 266/21 |
| 12,825 | 6/1908 | United Kingdom | 266/20 |

*Primary Examiner*—Gerald A. Dost

[57] ABSTRACT

A rotary hearth for the continuous treating of metallurgical material which comprises a circular stationary hearth member having as flooring a rotating platform, driven by conventional driving means positioned therebeneath. Heating, cooling and venting means are positioned at predetermined locations as said stationary member, as well as mixing rabbles therein for agitation of the material. The material, when treated, is removed either from a peripheral discharge, with the assistance of discharging baffles or the like, or from a centrally located opening with the assistance of a pair of screws which serve the purpose of advancing the feed from a peripherical initial feed-point to the centrally located discharge.

1 Claim, 6 Drawing Figures

ROTARY HEARTH

This is a continuation of application Ser. No. 226,819, filed Feb. 16, 1972, and now abandoned.

FIELD OF THE INVENTION

The present invention relates to hearths in general, for drying, calcimining, roasting and, generally, treating metallurgical ores and the like and, particularly, it relates to rotary hearths for the continuous treatment of metallurgical materials, although they might be also applicable to any other non-metallurgical process where materials are to be successively and continuously dried, heated, roasted and the like.

BACKGROUND OF THE INVENTION

Hearths and furnaces of the prior art which are generally utilized for the purposes mentioned above can be classified as stationary furnaces, rotary kilns, gravity rotationally discharging hearths, and the like.

Generally, more than one unit is necessary to accomplish the various step of a metallurgical ore-treating operation. Thus, for example, separate chambers are employed if the material to be treated requires, say, a pre-heating operation to drive off water and moisture prior to roasting, or if a predetermined cooling step is demanded after roasting, or if a number of different, temperature-dependent operations are to be carried out.

Furthermore, the same apparatus may be desired for handling materials which have inherently different characteristics. For example, some materials like perlite, require very gentle handling, because, being composed principally of silica, it cannot be tumbled in a rotary kiln and risk disintegration of its unique structure. Other materials possess varying amounts of water of hydration and necessitate stage-like handling in order to prevent bursting of particles.

The necessity, therefore, for a single, versatile apparatus for multi-purpose employment has long been felt by the industry, especially the metallurgical industry. Specifically needed is a hearth which is suitable for treating the most diversified materials, operates on a continuous basis, is capable of a high thermal efficiency in the transfer of heat from the heat source to the material, incorporates within a continuous operation a number of variable procedural steps, has a minimum of material losses, requires a minimum of operating labor, replacement parts and shut-downs, and is suitable to be used with varied feed rates, retention time and recovery rates.

SUMMARY OF THE INVENTION

All of the above requirements, the combination of which is lacking in any known apparatus, are met by the present invention, which provides for a rotary hearth composed of a stationary enclosed portion and of rotating platform thereunder, moved carousel-style by mechanical means. The motor drives a gear reduction train and the platform runs on a circular guide rail for proper alignment and engagement. The material is fed to the hearth by any one of known conventional means, such as screw feeders or jets and is subjected to direct or indirect heating, after which it is discharged on a continuous basis, commensurate with the feed rate.

It is another object of the present invention to provide for a rotary hearth which may be either donut-shaped or not and which has alternate discharging features as well as alternate heating means and feeding means.

THE DRAWINGS

These and other objects of the invention will become more apparent from the following detailed description of the embodiments thereof and from the accompanying drawings, in which.

DETAILED DESCRIPTION OF THE INVENTION

Figure 1:
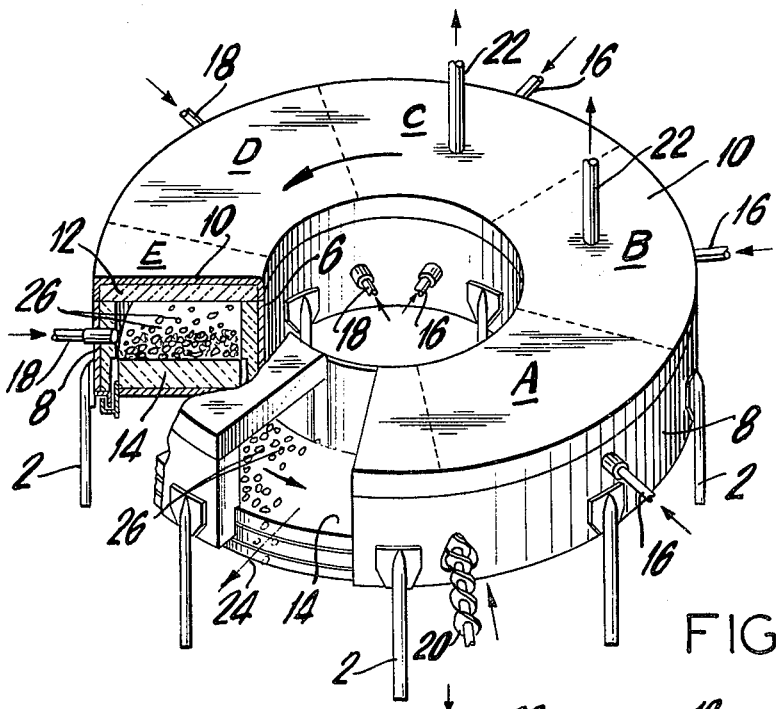
FIG. 1 is a perspective elevational view of a first embodiment of the rotary hearth, partly in section.

With reference to the drawings and, particularly to FIG. 1 thereof, the rotary hearth of the invention is circular and annularly shaped and it stands on a plurality of supports 2 in order to allow the necessary clearance underneath for the platform rotating means. The hearth is formed of a stationary portion 4 which has a fixed inner circular wall 6, an outer circumferential wall 8 and a roof 10. The two walls and the roof are provided with insulating material, such as bricks 12 and constitute, combined, a circular tunnel through which the material to be treated travels.

Forming the flooring of the tunnel and detached therefrom, in order to permit angular rotation, there is a platform 14 which carries to material to be treated. The platform and the tunnel, although detached from each other, are provided with sealing means (not shown) to prevent material losses, both solid and gaseous, as well as heat losses. The tunnel is divided into sections, the number of which varies depending on the process to which the hearth is applied. In FIG. 1 five such sections, A–E are indicated, each one reflecting a particular stage of the operation.

Heat sources 16 are distributed throughout a number of sections, usually the first ones in the sequential order of rotation, indicated typically as counterclockwise by the arrow, in FIG. 1. These heat sources may be applied to the inner wall 6 and/or to the outer wall 8 and/or to the roof 10 of the hearth. The number of sources is discretional, since not all need be employed at one time. The last section or number of sections in the sequential rotation may be provided with Cooling means 18, instead of heating means, so as to provide the hearth with one or more cooling sections. However, these may be replaced by additional heat sources, if so desired. Any number of elements 16 and 18 may be set up so as to be alternately employed for heating or cooling purposes. Generally, the heat sources are burners, using either natural gas or light fuel oil and the cooling means are air jets and both are, usually, applying the heat (or coolant) directly to the material inside the tunnel 4 by being located within apertures provided therefor. However, other heating means may be used, such indirect electric heating, in which case, presumably, a different type of insulation 12 or no insulation at all is needed, the only requirement being a corrosion resistant shield against the chemical action of the material in the tunnel.

One or more feeders are provided near the beginning of the rotational cycle. These feeders, indicated illustratively at 20, may be located vertically, or at an angle through the roof 10 of the hearth, or horizontally or at an angle through the outer wall 8 of the hearth. They may feed the material by means of a screw feeder, or a screw conveyor, or a belt conveyor (if a check valve is provided to prevent gaseous backaction) or by jet-action. The last mentioned type of feeder is suitable if the reaction to be carried out in the tunnel requires either a carrier gas or an oxidizing gas.

A number of outlets 22 are provided either on the roof of the various sections and/or on the sides (inner and/or outer walls) of the hearth. The proper location depends on the elected location of the burners and coolers, so as not to interfere therewith. Generally, the purpose of these outlets being the removal of vapors and moisture during heating of the material, the exhaust ports of the outlets are upwardly directed or inclined. It is preferable to have such outlets positioned in every section of the hearth, because their function may be reversed, that is, they may be utilized as inlets for the addition of compounds, oxidizers, reducers, etc. at any one of the sections in the procedure. It may even be that while some of the outlets are exhausting, other are intaking and still others are left inoperative and capped off.

At the conclusion of the process, that is in the vicinity of the feeding station, there is provided a discharge outlet 24, which actually constitutes a break in the otherwise totally annular hearth tunnel. The material 26 is discharged by mechanical means hereinafter described through such aperture 24. Of course, to separate the initial stage of the process from the concluding stage, there is preferably a barrier 26 which separates the incoming from the outgoing material, thus preventing that some treated material reenter the feeding stage. Any conventional barrier may be utilized.

Figure 2:
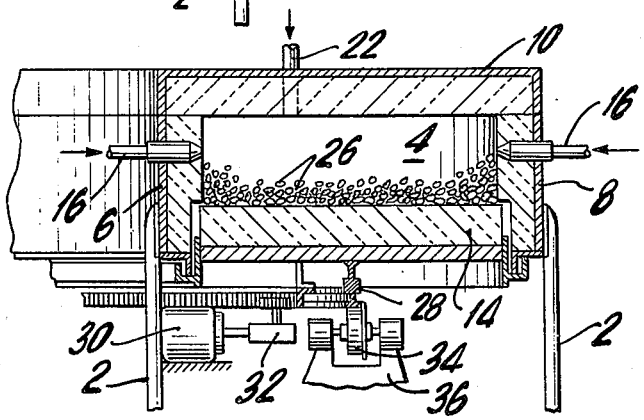
FIG. 2 is a detailed view of the moving means for the rotating platform of the hearth of the invention.

The rotary platform 14 is being rotated at a very slow rate by the means shown in FIG. 2. The platform carries underneath it a guide rail 28, preferably centrally located, radially speaking, and is guided by a drive assembly composed, typical of a motor 30, gear reducers 32 and a moving member 34 located atop of a grounded pedestal or support 36.

The speed of rotation may vary from process to process, depending on the exigencies of the operation. It varies also with respect to the diameter of the hearth. Generally, a drive assembly is selected which drives the platform at an average rate of about one revolution per 60–120 minutes. From this it can be seen that a single drive assembly suffices. This is generally located underneath one of the coolest sections of the hearth, usually the one near the discharge outlet, because it is often times a cooling section, or near the feeding point, because the weight of the material here is usually the greatest.

Throughout the hearth tunnel, there may be also provided one or more rabbles (not shown) or plows for the purpose of turning over and, generally, gently agitating and mixing the material during rotation, so that uniformity of process treatment be easily achieved. These means are well known in the art and need not be further described here.

Figure 4:
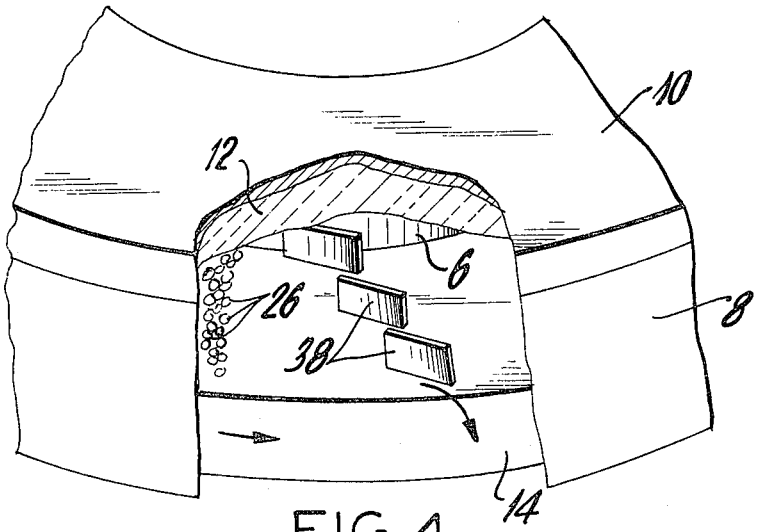
FIGS. 4–6 are detailed, schematic views of variants of the discharging means of the hearth.
Figure 5:
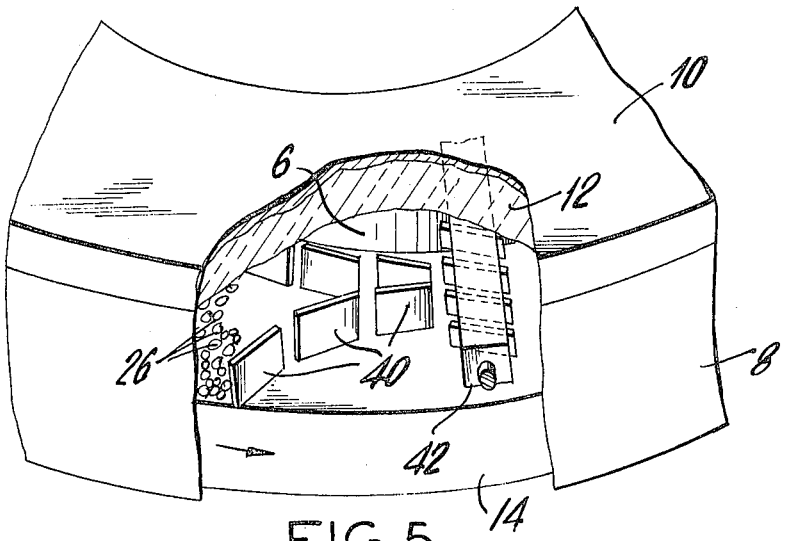
Figure 6:
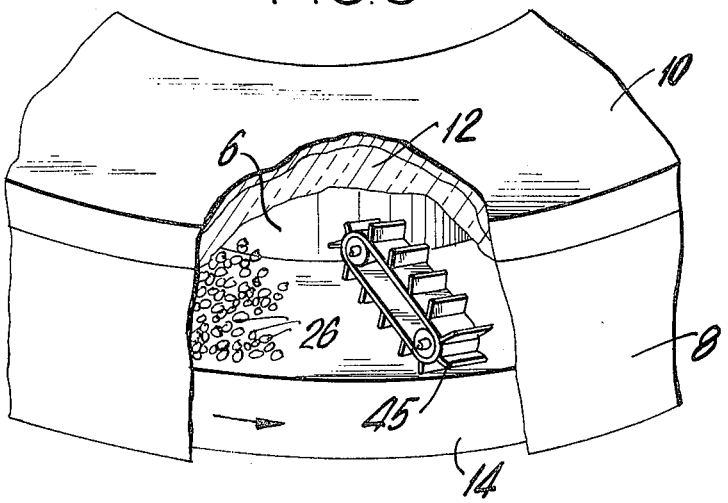

Referring now to FIGS. 4–6, several means for mechanically discharging the product, after treating, are shown. If no such means were utilized, it is quite conceivable that it would pile up thus applying additional unnecessary strain on the drive assembly and upset the timing in the rotation of the platform. One such discharging means may be a series of diagonally positioned baffles 38, overlapping one another, as illustrated in FIG. 4; here, the material is gradually pushed outwardly against the outer wall of the hearth and falls out by gravity from the discharge outlet (arrow). They are fixedly attached to the roof of the hearth and have a small clearance with the rotating platform 14. Another type of discharging means is shown in FIG. 5 and it is composed of progressively restrictive baffles 40 which are fixed to the roof and clear the platform of material by herding it toward a screw conveyor 42 which removes the material from the hearth. It is, of course, possible to utilize simply a conveyor like that shown at 42 without any baffles. Still another variant of removing means is shown in FIG. 6, where a chains-and-paddles mechanism 45 may be employed to accomplish the discharge of the material.

Figure 3:
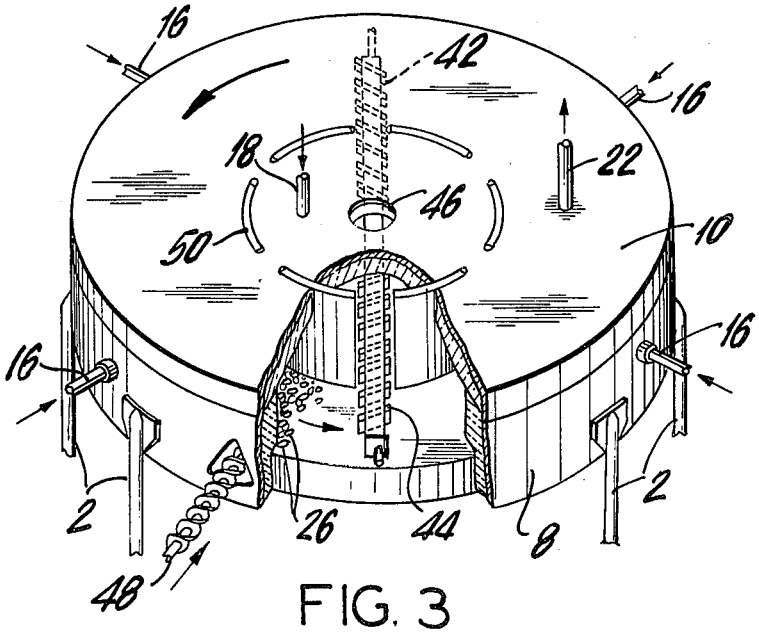
FIG. 3 is a schematic, perspective view of a second embodiment of the rotary hearth of the invention.

Another embodiment of the invention is illustrated in FIG. 3 of the drawings, where identical reference characters represent identical elements of the hearth. The hearth is not sectionalized, as the previously described one, but is composed of a fully circular chamber with a relatively small discharge opening 46 at the center thereof. The heat sources, burners 16, are located all around the outer wall 8 of the hearth at predetermined intervals or they may be located at the top of the hearth, that is on the roof 10 near the periphery. Auxiliary outlets for removal of volatiles and vapors are indicated at 22, similarly to the previously described hearth. These outlets, however may be absent, because the discharge opening 46 may be of sufficient diameter to allow for the escape of the gaseous components. It is preferable to have the heating means 16 peripherically disposed all around the hearth's outer wall 8, if the material is also to be cooled, in which case the cooling means 18 are located vertically on the roof in the proximity of the discharge opening 46. The material is fed through the outside wall by a screw feeding mechanism 48 and it is deposited marginally along the periphery of the rotating platform (not shown). Driving means, similar to those of the previously described hearth are positioned underneath the platform to rotate the same, as explained herebefore. Two plows 42, 44 are positioned preferably on a common axis inside the hearth, in the figure, and serve the purpose of slowly moving the material from the periphery toward the central discharge 46. The platform, contrary to the previously described one, effects a greater number of revolutions prior to discharging the material, each revolution causing the material to be advanced, as in an Archimedes' spiral, toward the center in an ever smaller circle by the action of the two plows which, concurrently, turn the material over and expose it fully to the heat sources. After some 20 to 40 revolutions, the material falls through the discharge opening (not shown) and opposite to opening 46 and is removed. If cooling means are employed toward the center of the hearth, a baffle 50 provided with heatinsulating means, may be circularly inserted through the roof 10 to divide the hearth into concentric heating and cooling regions. The baffle 50 may be removed and the slot through which is inserted may be sealed by means known in the art and the cooling inlets 18 may be capped off, if cooling is not employed in the process.

It is understood that many variances may be introduced in the hearth of the invention without departing from the spirit and scope thereof.

What I claim and wish to secure by Letters Patent of the United States is:

1. In a rotary hearth suitable for continuously treating metallurgical material, the improvement which comprises in combination;

a. a stationary circular hearth member having an outer wall, an inner wall and a roof, said walls and roof being heat-insulated and fixedly connected to one another;

b. supports for said stationary circular hearth member to hold it in an elevated position with respect to the ground;

c. a rotating platform positioned underneath said stationary hearth member and forming the flooring thereof, said platform being provided with guide rails and roller units on the underside thereof and with sealing means to prevent heat and gas losses;

d. feeding means for the metallurgical material positioned in relationship with said stationary hearth member for continuously feeding the material thereto;

e. driving means cooperating with said guide rails and roller units for rotating said platform circularly around said hearth member;

f. a plurality of inlets positioned in relationship to said stationary hearth member to convey heat to the metallurgical material on said rotating platform;

g. a plurality of outlets positioned in relationship to said stationary hearth member to remove volatile matter from the metallurgical material;

h. means for mixing and turning the material during its rotational movement on said platform, said means being located at predetermined points inside of and attached to said stationary hearth member along the path of travel of the material;

i. a centrally located discharge outlet in said stationary hearth member for the discharging of the material therefrom;

j. a pair of radially and oppositely positioned plows for gradual advancement of the material from said outer wall to said discharge outlet;

k. a plurality of overlapping baffles vertically positioned between said inner and outer walls of said hearth for gradually moving the material through said outlet; and l. a heat-insulating circular baffle positioned inside said hearth member concentrically with respect to said outer wall and in the proximity of said discharge outlet, said baffle being vertically slidable through said roof.

* * * * *